US005897418A

United States Patent [19]

Spector

[11] Patent Number: 5,897,418

[45] Date of Patent: Apr. 27, 1999

[54] TEST TUBE DOLL PACKAGE

[76] Inventor: Donald Spector, 380 Mountain Rd., Union City, N.J. 07080

[21] Appl. No.: 09/074,871

[22] Filed: May 8, 1998

[51] Int. Cl.[6] ..... A63H 3/00; A63H 3/02; B65D 73/00

[52] U.S. Cl. ..... 446/268; 446/369; 206/457

[58] Field of Search ..... 446/268, 267, 446/368, 369, 153; 206/457, 524.8; 215/355; D21/594; D24/229; D9/307, 337, 521

[56] References Cited

U.S. PATENT DOCUMENTS

| | | | |
|---|---|---|---|
| D. 260,731 | 9/1981 | Sarac | 446/268 X |
| 2,760,302 | 8/1956 | Cheskin | 446/153 X |
| 3,238,599 | 3/1966 | Bauman | 446/369 X |
| 3,354,578 | 11/1967 | Ryan | 446/369 |
| 4,768,653 | 9/1988 | Desai et al. | 206/524.8 |
| 4,881,915 | 11/1989 | Liaw | 446/368 X |
| 4,936,460 | 6/1990 | Meyer | 206/524.8 |
| 4,964,831 | 10/1990 | Wolff | 446/268 X |
| 5,027,457 | 7/1991 | Sweet | 446/369 X |
| 5,503,274 | 4/1996 | Toffler et al. | 206/457 |

*Primary Examiner*—Neal Muir
*Attorney, Agent, or Firm*—Michael Ebert

[57] ABSTRACT

A doll packaged in a test tube, the doll being constituted by a baby figure formed of compressible material whose plasticity is such that when the figure is compressed and thereafter released, it recovers its normal shape and size. When compressed, air is expelled therefrom and the figure is in a shrunken state so that it can be stuffed into the test tube which is then sealed by a stopper. To play with the doll, the stopper is removed and the figure is taken out of the test tube, the figure then inhaling air to recover its normal size and shape.

8 Claims, 1 Drawing Sheet

FIG. 1
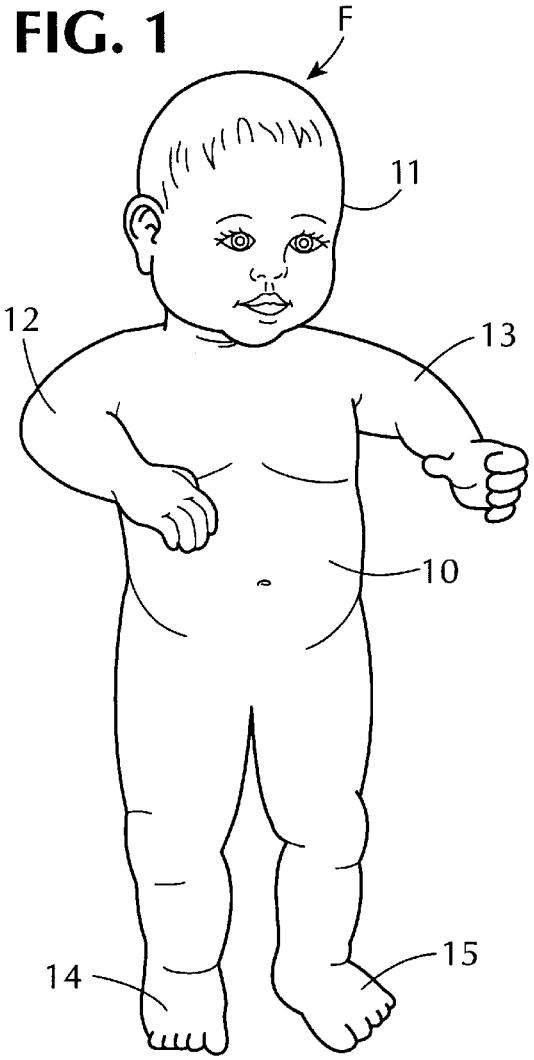
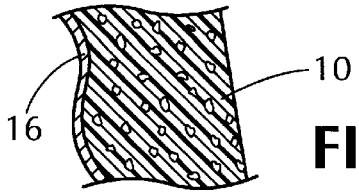
FIG. 2
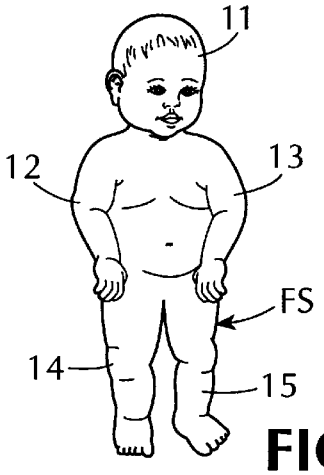
FIG. 3
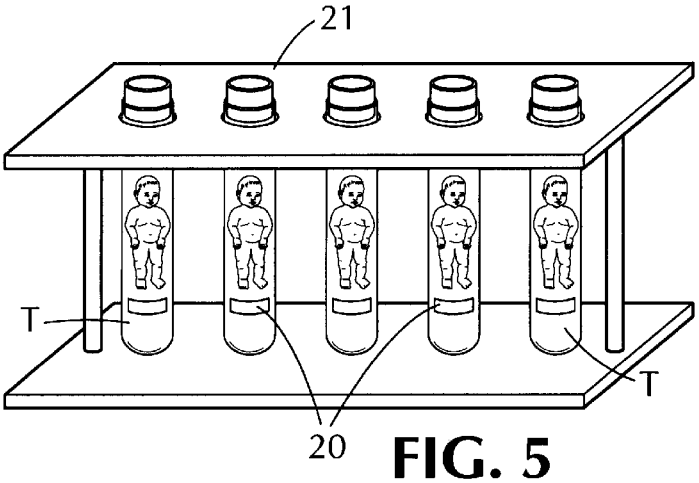
FIG. 5
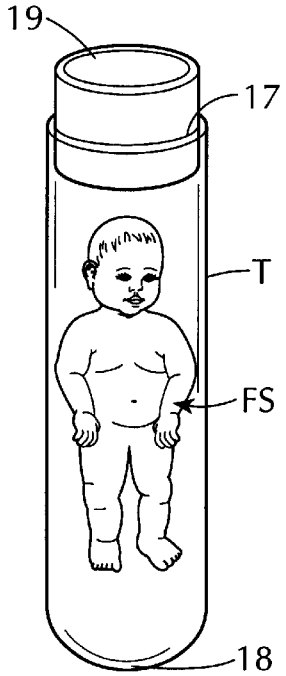
FIG. 4

TEST TUBE DOLL PACKAGE

BACKGROUND OF THE INVENTION

1. Field of Invention

This invention relates generally to doll packages, and more particularly to a doll package in which a doll in a compressed and shrunken state is stuffed into a test tube, the doll when taken out of the tube then recovering its normal size and shape.

2. Status of Prior Art

Children use dolls in order to simulate adult experiences, such as giving birth and taking care of a baby. Hence a child not only wishes to play with a doll resembling a baby, but with a nursing bottle and baby carriage for the baby. Thus when a child acquires a "Cabbage Patch Kids" doll, the child must fill out a birth certificate as well as adoption papers, and is required to give her adopted baby a name.

Not all babies come into existence as a result of natural birth. In this age of medical advances, not uncommon is a test tube baby developed from an egg fertilized outside of the body and then implanted in the uterus of a surrogate mother. While "test tube" refers to a clear tube open at one end and rounded on the other, this term also means conceived by or developed from artificial insemination. The present invention, in packaging in a test tube a baby doll, literally provides a test tube baby.

It is known to package small dolls and other items in a container resembling a nursing bottle having a nipple. One such package is disclosed in the Doorman et al. U.S. Pat. No. 4,878,867.

SUMMARY OF INVENTION

In view of the foregoing, the main object of this invention is to provide a doll packaged in a test tube, thereby suggesting that the doll was conceived in the tube.

More particularly, an object of this invention is to provide a test tube package in which the doll stuffed into the test tube is a baby doll, thereby making this doll a test tube baby.

Also an object of this invention is to provide a set of test tube doll packages, each tube having a distinct decorative label or liner whereby when the doll stuffed in the tube is removed therefrom, the tube then becomes a collectible.

Briefly stated, these objects are attained by a doll packaged in a test tube, the doll being constituted by a figure such as that of a baby, formed of compressible porous material whose plasticity is such that when the figure is compressed and thereafter released, it recovers its normal shape and size. When compressed, air is expelled therefrom and the figure is in a shrunken state so that it can be stuffed into the test tube which is then sealed by a stopper.

To play with the doll, the stopper is removed and the figure is taken out of the test tube, the figure then inhaling air to recover its normal size and shape. Each test tube is so decorated that when the figure is removed therefrom, the empty tube may be retained as a collectible.

BRIEF DESCRIPTION OF DRAWING

For a better understanding of the invention as well as other objects and further features thereof, reference is made to the following detailed description to be read in conjunction with the accompanying drawings, wherein:

FIG. 1 illustrates a compressible baby doll in accordance with the invention;

FIG. 2 is a section taken through a modified form of baby doll;

FIG. 3 shows the doll in a shrunken state;

FIG. 4 illustrates the shrunken doll stuffed in a test tube to form a package; and FIG. 5 shows a group of empty test tubes in a stand therefor.

DESCRIPTION OF INVENTION

Referring now to FIG. 1, shown therein is a doll whose figure F is that of a baby having a torso 10, a head 11, a pair of arm appendages 12 and 13, and a pair of leg appendages 14 and 15.

Figure F is molded of low-density, flexible, open-cell foam plastic material, such as polyurethane. This foam material is highly compressible, yet its plasticity is such that regardless of how the figure is deformed under compression, when the compressive stresses are released, the figure then fully recovers its normal shape and size.

The figure shown in FIG. 1 is made entirely of foam plastic material and is effectively naked, even though its surface is colored to create facial features of a baby. But in practice, as shown in FIG. 2, the figure may be fully or partially enveloped in a fabric outer casing 16 which is air permeable. Hence when the figure is compressed, air expelled from the open cells of the foam-plastic material passes through the porous fabric. When the figure is enveloped in an outer fabric casing, instead of a foam plastic body, the casing may be stuffed with fiberfill or other compressible material to cause the shaped casing to assume the form of a baby.

In a package in accordance with the invention, figure F is compressed to expel the air therefrom and thereby form a shrunken figure FS, as shown in FIG. 3. To effect such compression, the figure may be subjected to manual compression. Preferably, compression is effected in a vacuum chamber in which substantially all of the air entrapped within the porous figure is extracted to shrink the figure.

The shrunken figure is then stuffed into a test tube T, as shown in FIG. 4, preferably molded of a transparent synthetic plastic, such as polyethylene, having an open mouth 17 and a rounded bottom 18. After the figure is stuffed into the test tube, the tube is sealed by a removable cork or stopper 19.

The resultant package is literally a test tube baby, and for a child to play with this baby, all that is necessary is to remove stopper 19 and then pull shrunken figure FS out of the tube. When taken out of the tube and exposed to the atmosphere, shrunken figure FS, as it expands, inhales air and in doing so recovers its normal size and shape, as shown in FIG. 1.

The invention is not limited to baby figures, for in practice other figures may be used, such as those of young animals or characters.

Though a baby figure is stuffed into each test tube, the figures may be distinctive so that no two babies look the same. Thus one baby could be a white baby, a second, a black baby, and a third, an oriental baby. And some babies could be girls and others, boys.

In order to identify the baby doll stuffed in the test tube, each tube T, as shown in FIG. 5, may be provided with a decorative label 20 adhered to the outside of the tube or to its inside surface. Each label carries an illustration of the baby in the tube. Hence when a tube is empty, it need not be discarded, but may be retained as an attractive collectible.

FIG. 5 shows an array of empty tubes T supported upright in a stand 21 to display their labels. In practice, instead of labels, each tube may be provided with one or more decorative paper rings, similar to that encircling a cigar.

Test tube 15 need not be of a standard laboratory test tube size, but may be somewhat larger both in diameter and length to accommodate a more sizable doll than can be stuffed into a tube of standard size.

While there has been shown and described a preferred embodiment of a test tube doll package in accordance with the invention, it will be appreciated that many changes and modifications may be made therein without, however, departing from the essential spirit thereof.

I claim:

1. A doll or figure package comprising:

A. a test tube having an open mouth; and

B. a single doll figure formed of air-permeable compressible material having sufficient plasticity whereby after being subjected to deformation, it is capable of recovering its normal shape and size, each figure being compressed to expel air therefrom and to cause the figure to assume a shrunken state in which it is stuffed into said test tube so that an upper end of the shrunken figure is then adjacent the mouth of the test tube, whereby when the figure is thereafter taken out of the tube, it inhales air to recover its normal shape and size; and C. a stopper to seal the test tube having the shrunken figure stuffed therein, said stopper being inserted in the mouth of the test tube to abut the upper end of the figure, the stopper projecting from the mouth of the test tube to facilitate its removal to expose the upper end of the shrunken figure to air which is inhaled thereby so that the shrunken figure can then be taken out of the test tube to recover its normal shape and size.

2. A doll package as set forth in claim 1, in which the doll figure is that of a baby.

3. A doll package as set forth in claim 1, in which the figure is that of a character.

4. A doll package as set forth in claim 1, in which the figure is molded of flexible, open-cell foam plastic material.

5. A doll package as set forth in claim 4, in which the material is polyurethane.

6. A doll package as set forth in claim 1, in which the figure is enveloped in a fabric outer casing.

7. A doll package as set forth in claim 6, in which the casing is filled with compressible fiberfill.

8. A doll package as set forth in claim 1, in which the test tube is formed of transparent synthetic plastic material.

* * * * *